US006540024B2

(12) United States Patent
Pallini et al.

(10) Patent No.: US 6,540,024 B2
(45) Date of Patent: Apr. 1, 2003

(54) SMALL DIAMETER EXTERNAL PRODUCTION RISER TIEBACK CONNECTOR

(75) Inventors: Joe Pallini, Tomball, TX (US); Kim H. Phan, Houston, TX (US); Gilbert P. Mican, Sealy, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/865,288

(22) Filed: May 25, 2001

(65) Prior Publication Data

US 2001/0045286 A1 Nov. 29, 2001

Related U.S. Application Data

(60) Provisional application No. 60/207,707, filed on May 26, 2000.

(51) Int. Cl.[7] ..... E21B 29/12

(52) U.S. Cl. ..... 166/348; 166/359; 166/347

(58) Field of Search ..... 166/348, 365, 166/349, 345, 359, 368, 347; 405/224; 285/18, 920, 101

(56) References Cited

U.S. PATENT DOCUMENTS

| | | | | |
|---|---|---|---|---|
| 3,163,223 | A | | 12/1964 | Bauer et al. |
| 3,222,088 | A | * | 12/1965 | Haeber |
| 3,321,217 | A | | 5/1967 | Ahlstone |
| 3,450,421 | A | * | 6/1969 | Harwell, Jr. |
| 3,543,847 | A | * | 12/1970 | Haeber |
| 3,933,202 | A | | 1/1976 | Ahlstone |
| 4,057,267 | A | | 11/1977 | Jansen |
| 4,114,928 | A | * | 9/1978 | Lochte ..... 285/18 |
| 4,153,278 | A | | 5/1979 | Ahlstone |
| 4,408,783 | A | | 10/1983 | Gruller |
| 4,408,784 | A | | 10/1983 | Reimert |
| 4,433,859 | A | | 2/1984 | Driver et al. |
| 4,441,741 | A | * | 4/1984 | Galle, Jr. ..... 166/340 |

(List continued on next page.)

FOREIGN PATENT DOCUMENTS

| | | |
|---|---|---|
| GB | 1197680 | 7/1968 |
| GB | 2091367 A | 7/1982 |
| GB | 2162919 A | 9/1982 |
| GB | 2102522 A | 2/1983 |
| GB | 2111625 A | 7/1983 |
| GB | 2165908 A | 10/1984 |
| GB | 2176547 A | 4/1985 |
| GB | 2268990 A | 1/1994 |
| GB | 2276428 A | 9/1994 |
| GB | 2319317 A | 11/1996 |
| GB | 2335684 A | 9/1999 |
| GB | 2340572 A | 2/2000 |

*Primary Examiner*—Thomas B. Will
*Assistant Examiner*—Thomas A. Beach
(74) *Attorney, Agent, or Firm*—Bracewell & Patterson, L.L.P.

(57) ABSTRACT

A tieback connector includes a passive lower locking system and an active upper locking system to exert a positive locking force on the connection between a production riser and a high pressure wellhead. The tieback connector is composed of an outer housing which carries lower locking dogs, upper locking dogs and a piston. The piston is located above the lower end of the production riser and controls the movement of the outer housing. As the piston is stroked the outer housing cams the lower dogs into grooved profile in the wellhead housing. As the piston is stroked further the upper dogs exert a force onto the production riser that locks the riser to the wellhead housing.

18 Claims, 6 Drawing Sheets

U.S. PATENT DOCUMENTS 4,496,172 A * 1/1985 Walker ..... 285/18
4,526,406 A 7/1985 Nelson
4,647,254 A * 3/1987 Baugh et al. ..... 166/345
4,681,166 A 7/1987 Cuiper
4,693,497 A 9/1987 Pettus et al.
4,696,493 A 9/1987 Brammer
4,699,215 A * 10/1987 Cuiper ..... 166/341
4,708,376 A 11/1987 Jennings et al.
4,754,813 A * 7/1988 Jennings et al. ..... 137/607
4,759,409 A * 7/1988 Gullion ..... 166/182
4,819,967 A 4/1989 Calder et al.
4,856,594 A 8/1989 Jennings
4,893,842 A 1/1990 Brammer
4,902,044 A * 2/1990 Williams et al. ..... 166/340
4,919,454 A 4/1990 Caulfield et al.
5,020,942 A 6/1991 Pallini
5,069,288 A 12/1991 Singeetham
5,163,514 A 11/1992 Jennings
5,168,933 A 12/1992 Pritchard et al.
5,174,376 A 12/1992 Singeetham
5,222,560 A 6/1993 Brammer et al.
5,255,743 A * 10/1993 Adam et al. ..... 166/345
5,255,746 A * 10/1993 Bridges ..... 166/348
5,259,459 A 11/1993 Valka
5,279,369 A 1/1994 Brammer
5,299,642 A 4/1994 Nelson et al.
5,503,230 A 4/1996 Osborne et al.
5,566,761 A 10/1996 Pallini et al.
5,638,903 A * 6/1997 Kent ..... 166/208
5,775,427 A 7/1998 Skeels et al.
6,035,938 A 3/2000 Watkins
6,070,669 A * 6/2000 Radi et al. ..... 166/341
6,138,762 A * 10/2000 Sweeney et al. ..... 166/338
6,234,252 B1 5/2001 Pallini et al.
6,260,624 B1 6/2001 Pallini et al.
6,293,343 B1 * 9/2001 Pallini et al. ..... 166/345

* cited by examiner

SMALL DIAMETER EXTERNAL PRODUCTION RISER TIEBACK CONNECTOR

This application claims the benefit of U.S. Provisional Application No. 60/207,707, filed May 26, 2000.

BACKGROUND OF THE INVENTION

1. Field of the Invention

The present invention relates generally subsea petroleum production. More specifically, the present invention relates to production riser tiebacks which connect a production riser to a high pressure wellhead housing.

2. Description of the Related Art

Tieback connectors are used to connect a production or drilling riser to a high pressure wellhead housing. The connector must be able to withstand very large forces to keep the riser sealed to the wellhead housing. This has required rather bulky connectors to withstand these forces.

One type of tieback connector connects to a grooved profile on the exterior of the high pressure wellhead housing. The tieback connector has a cylindrical housing that slides over the upper end of the wellhead housing. A cam member, piston, and a plurality of segments are carried in the housing. Applying hydraulic pressure to the piston strokes the cam member, pushing the dogs into engagement with the grooved profile. The housing of the connector has a fairly large diameter in order to accommodate the piston, cam member and dogs. Some production platforms are designed with relatively small holes or slots through which the connector must pass. This necessitates a connector with a smaller outer diameter.

BRIEF SUMMARY OF THE INVENTION

A tieback connector comprises a passive lower locking system and an active upper locking system to exert a positive locking force on the connection between a production riser and a high pressure wellhead. The tieback connector is comprised of an outer housing which carries lower locking dogs, upper locking dogs and a piston. The piston is located above the lower end of the production riser and controls the movement of the outer housing. As the piston is stroked the outer housing cams the lower dogs into grooved profile in the wellhead housing. As the piston is stroked further the upper dogs exert a force onto the production riser that locks the riser to the wellhead housing.

DETAILED DESCRIPTION OF THE PREFERRED EMBODIMENT

Figure 1:
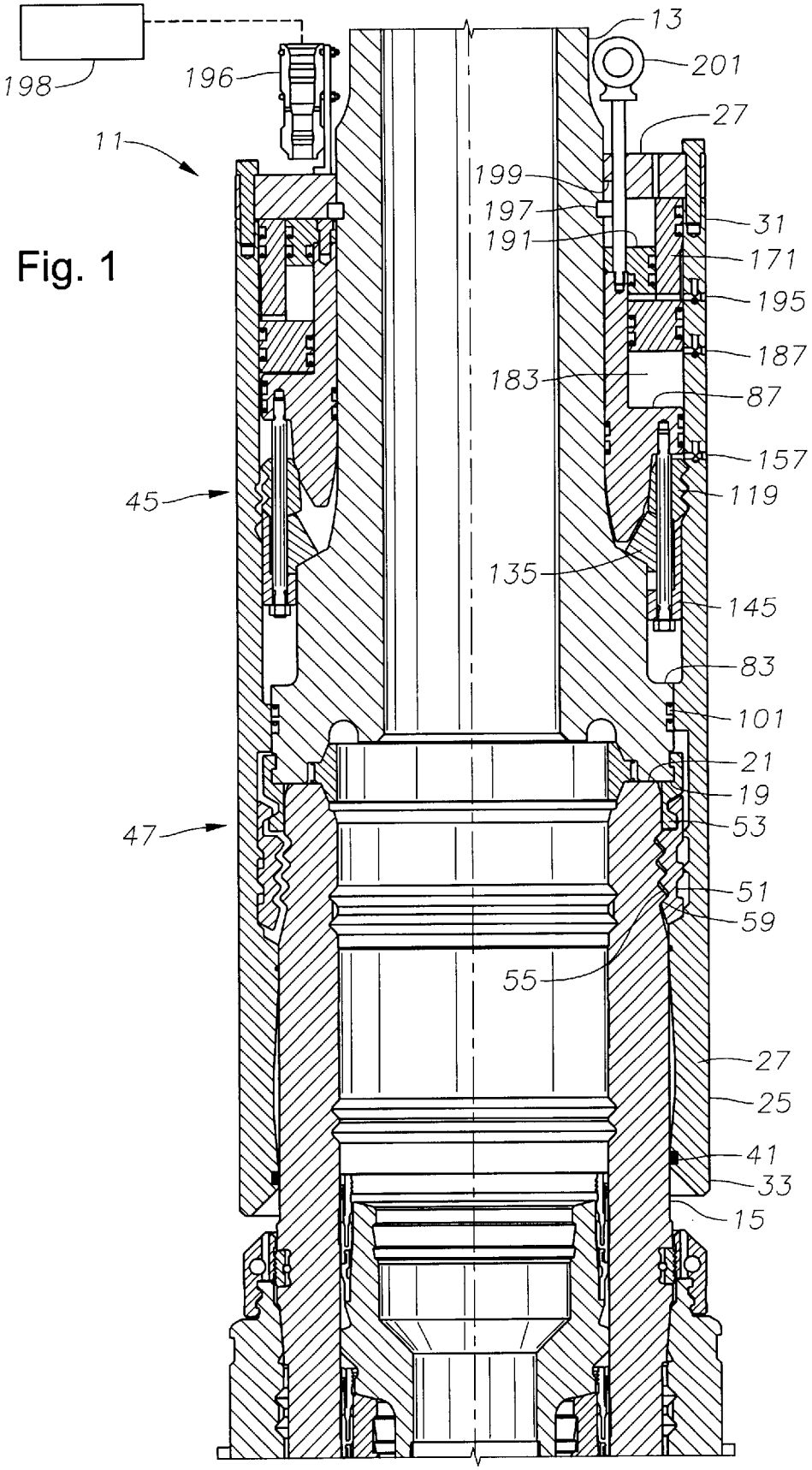
FIG. 1 is a cross sectional view of the tieback connector of this invention showing a locked position on the right and an unlocked position on the left.

Referring to FIG. 1 in the drawings, the preferred embodiment of a small diameter external tieback connector 11 according to the present invention is illustrated. Tieback connector 11 is used to join a lower terminal end of a drilling or production riser 13 to a high pressure wellhead housing 15 in off shore drilling applications. Typically, the high pressure wellhead housing 15 is installed during drilling operations, and production riser 13 is attached to the wellhead housing 15 to facilitate completion and production of the well. Production riser 13 and tieback connector 11 are lowered through a slot at a surface platform (not shown). Production riser 13 includes an interior surface and an exterior surface with a riser shoulder 19 formed at a lower end of the production riser 13. Wellhead housing 15 includes an interior surface and an exterior surface with a wellhead shoulder 21 formed at an upper end of the wellhead housing 15. Upon connection, the wellhead shoulder 21 mates with the riser shoulder 19, and the interior surfaces of the wellhead housing 15 and the production riser 13 form a common bore, in which production tubing is then located to deliver oil from the well to the ocean surface.

Tieback connector 11 includes a housing 25 having a generally cylindrical wall 27 with an interior surface and an exterior surface. An upper end cap 29 is rigidly attached to the housing 25 at an upper end 31 of the housing 25, the upper end cap 29 having a passage through which production riser 13 passes. The housing 25 and upper end cap 29 slidingly engage the exterior surface of the production riser 13. The tieback connector 11 is prevented from sliding off the lower end of the production riser 13 by several parts internal to the housing 25 that are discussed in more detail below.

A lower end 33 of the housing 25 is open to receive wellhead housing 15 during connection of the production riser 13 and tieback connector 11 to the wellhead housing 15.

An initial connection is made by concentrically locating housing 25 relative to the wellhead housing 15 and lowering the production riser 13 until riser shoulder 19 engages wellhead shoulder 21. A seal 41 is disposed in a groove on the interior surface of the housing 25 near its lower end 33 to prevent seawater from entering the tieback connector 11 after the initial connection is made.

After initial connection, the housing 25 of tieback connector 11 is still capable of axial movement relative to the production riser 13 and the wellhead housing 15. The tieback connector 11 has an unlocked position in which the production riser 13 is not securely fastened to the wellhead housing 15. While making the initial connection and immediately after the initial connection, the tieback connector 11 is in the unlocked position. The tieback connector 11 also has a locked position which results in a secure connection between the production riser 13 and the wellhead housing 15. The tieback connector 11 is placed in the locked position before performing any completion or production operations.

The tieback connector 11 features an upper locking system 45 and a lower locking system 47 for securing the tieback connector 11 in the locked position. The lower locking system 47 is a passive locking system that provides the connection to the housing 25. The upper locking system 45 is an active locking system that provides a locking and preloading force. The lower locking system 47 includes a locking element that may be a split ring or collet, but is preferably a plurality of lower dogs 51 and a lower dog retainer ring 53 disposed within housing 25. Each lower dog 51 has a cylindrical curvature with a plurality of teeth 55 on an inner surface. The lower dogs 51 are arranged circumferentially around the interior of the housing 25, with the plurality of teeth 55 adapted to mate with a plurality of grooves 59 formed on the exterior surface of the wellhead housing 15. Typically, eight to twelve lower dogs 51 will be arranged within the housing 25. The lower dogs 51 are held within housing 25 by the lower dog retainer ring 53 which is connected to the lower end of the production riser 13.

Figure 3:
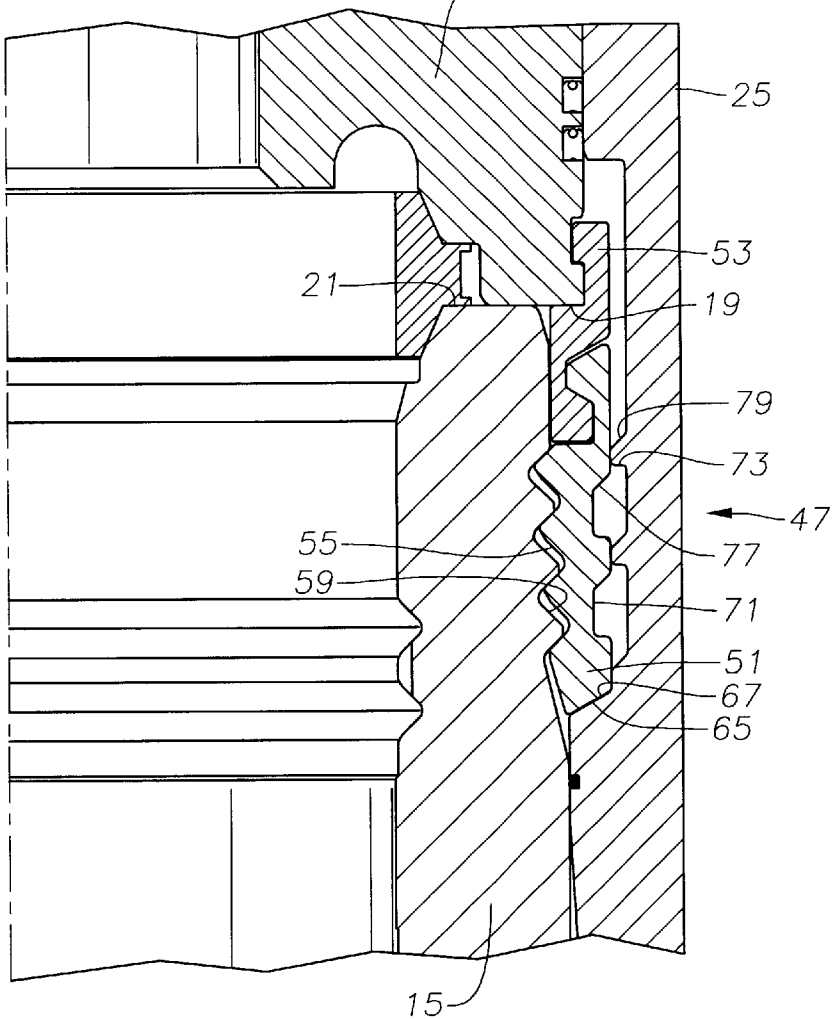
FIG. 3 is an enlarged view of a portion of the tieback connector in FIG. 1.
Figure 2:
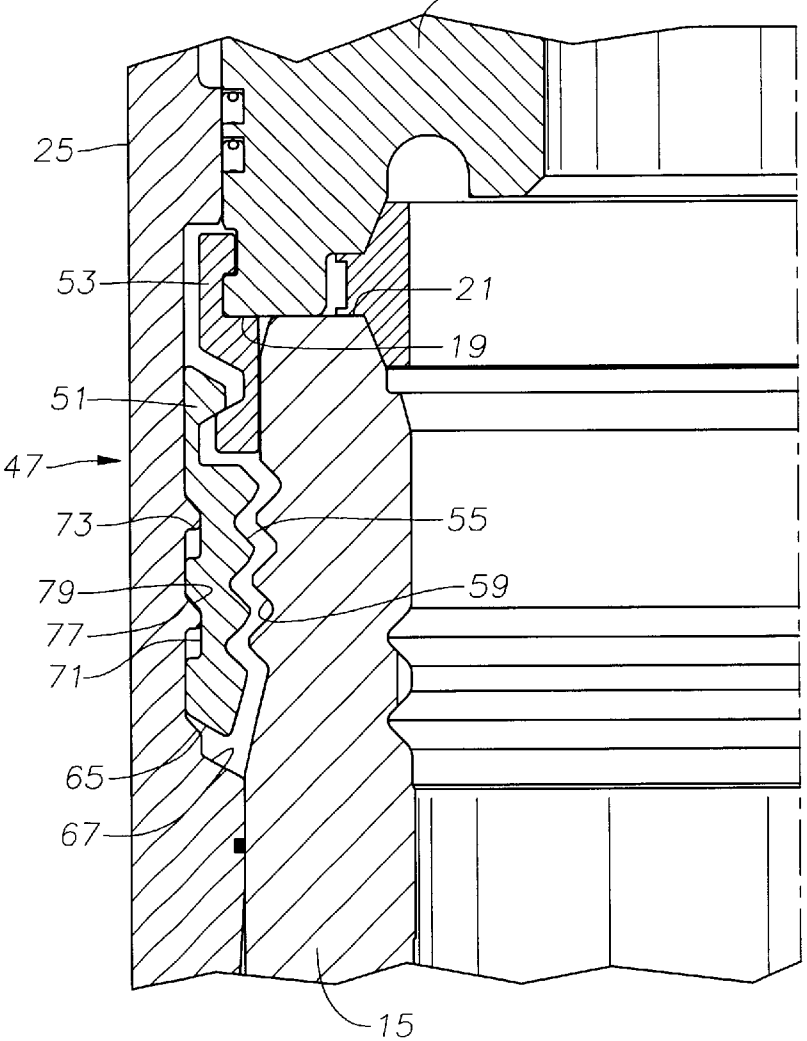
FIG. 2 is an enlarged view of a portion of the tieback connector in FIG. 1.

Referring to FIGS. 2 and 3 in the drawings, a more detailed view of the lower locking system 47 is illustrated. The lower dog 51 and housing 25 are shown in the unlocked position in FIG. 2. In FIG. 3, the lower dog 51 and housing 25 are shown in the locked position. Each lower dog 51 includes a stop shoulder 65 for mating with a landing shoulder 67 on the interior surface of the housing 25 when the tieback connector 11 is in the locked position. The stop shoulder 65 and the landing shoulder 67 are similarly inclined.

A plurality of outer grooves 71 are disposed on an outer surface of each lower dog 51. A plurality of bands 73 are integrally located on the interior surface of housing 25. Outer grooves 71 receive bands 73 when tieback connector 11 is in the unlocked position. Each outer groove 71 includes a conical cam surface 77 for engagement with a similarly inclined surface 79 on each band 73. In the locked position, bands 73 mate with the outer surface of each lower dog 51 such that the plurality of teeth 55 on the lower dog 51 engage the plurality of grooves 59 on the wellhead housing 15. Upward movement of housing 25 relative to riser 13 causes dogs 51 to move to the locked position.

Figure 4:
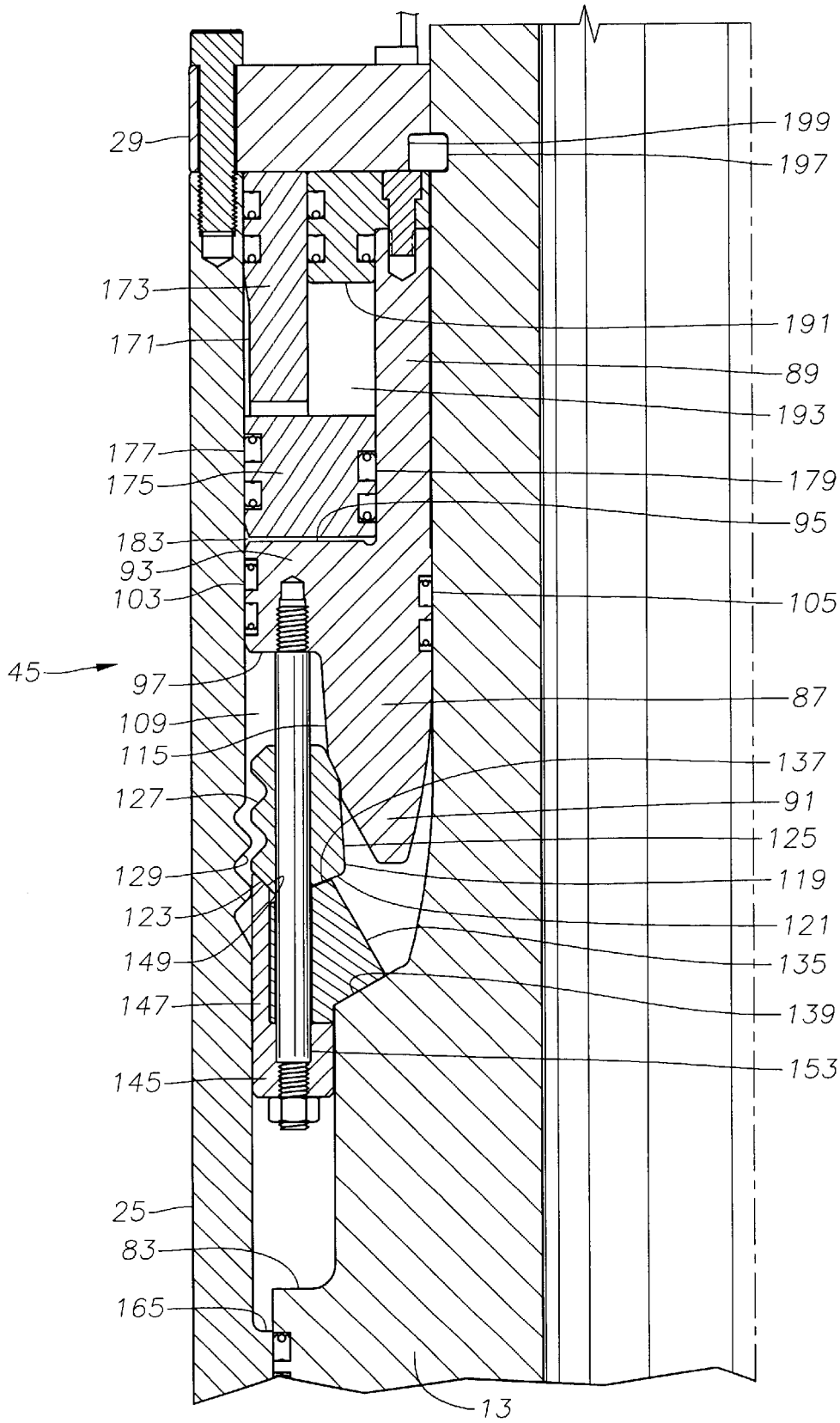
FIG. 4 is an enlarged view of a portion of the tieback connector in FIG. 1.
Figure 5:
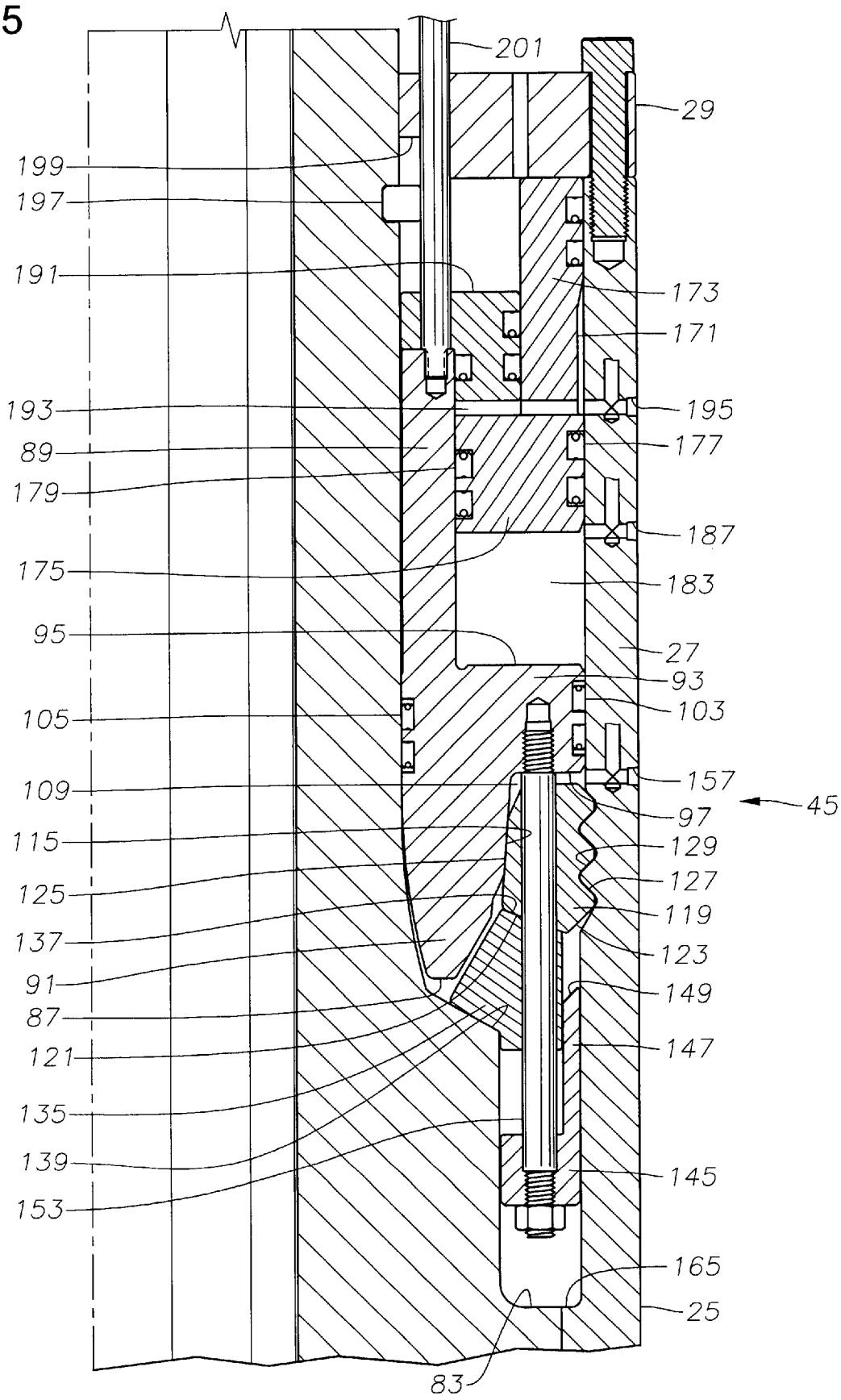
FIG. 5 is an enlarged view of a portion of the tieback connector in FIG. 1.

Referring to FIGS. 1, 4, and 5, production riser 13 includes an upward facing shoulder 83 located on the exterior surface near its lower end. Upper locking system 45 includes several parts that are generally located between the upward facing shoulder 83 and upper end cap 29. A piston 87 having an upper portion 89, a lower portion 91, and a pressure flange 93 is slidingly disposed in an annulus between the production riser 13 and the housing 25. Pressure flange 93 includes an upper side 95 and a lower side 97. Similar to the components comprising the lower locking system 47, the piston 87 is adapted to move between a locked and an unlocked position. Seals 101 located between the production riser 13 and housing 25 and seals 103, 105 disposed around the piston 87 form a lower chamber 109 beneath the lower side 97 of the piston 87.

Lower portion 91 of piston 87 includes an inclined locking surface 115. An upper locking element may be a split ring or collet, but is preferably a plurality of upper dogs 119 circumferentially disposed within the lower chamber 109. Each upper dog 119 has a lower landing surface 121, a lower retraction surface 123, and an interior locking surface 125. Each upper dog 119 also has a cylindrical curvature with a plurality of teeth 127 formed on an outer surface. The upper dogs 119 are arranged circumferentially around the interior of the housing 25, the plurality of teeth 127 mating with a plurality of grooves 129 formed on the interior surface of the housing 25 when the tieback connector 11 is in the locked position. Typically, eight to twelve upper dogs 119 will be arranged within the housing 25.

A load transfer ring 135 having an upper landing surface 137 rests on a step 139 formed in the outer surface of the production riser 13. Load transfer ring 135 is disposed below upper dog 119, the upper landing surface 137 slidingly engaging the lower landing surface 121 of the upper dog 119. A dog retraction ring 145 has a disengagement portion 147 with a retraction surface 149. Disengagement portion 147 is located in an annulus between the load transfer ring 135 and the housing 25. A retainer bolt 153 passes through a passage in the load transfer ring 135 and is rigidly connected between the dog retraction ring 145 and the piston 87. As the piston 87 moves axially between the locked and the unlocked positions, the dog retraction ring 145 also moves. The retraction surface 149 of the dog retraction ring 145 mates with the lower retraction surface 123 of the upper dog 119 as the dog retraction ring 145 moves into an unlocked position.

A primary release port 157 (FIG. 5) allows fluid communication with the lower chamber 109. Hydraulic fluid injected into the lower chamber 109 is capable of applying an upward force to the piston 87 and a downward force to a shoulder 165 formed on the interior surface of the housing 25.

An inner seal sleeve 171 is located above the upper side 95 of the piston 87 between the upper portion 89 of the piston 87 and the interior surface of the housing 25. Inner seal sleeve 171 has an upper portion 173 and a lower portion 175, the upper portion 173 abutting the upper end cap 29. Seals 177, 179 are disposed in the lower portion 175 of inner seal sleeve 171. An intermediate chamber 183 is formed above the upper side 95 of the piston 87 between seals 177, 179 and seals 103, 105.

A primary locking port 187 is disposed in the wall 27 of housing 25 for fluid communication with the intermediate chamber 183. Hydraulic fluid supplied to the intermediate chamber 183 is capable of applying a downward force to upper side 95 of piston 87.

A piston cap 191 is located in an annulus between the upper portion 173 of the inner seal sleeve 171 and the production riser 13. The piston cap 191 is rigidly connected to the upper portion 89 of the piston 87. Seals disposed around the piston cap 191 act in conjunction with seals 177, 179 to form an upper chamber 193. A secondary release port 195 is disposed in the wall 27 of housing 25 and passes through inner seal sleeve 171 for fluid communication with the upper chamber 193. Hydraulic fluid injected into the upper chamber 193 is capable of supplying an upward force on the piston cap 191 which is transmitted directly to the piston 87.

All of the pressure ports 157, 187, and 195 are connected to a series of valves and hot stab receptacles 196. An external hydraulic pressure source 198 (schematically shown in FIG. 1) operates the connector 11 through the receptacles 196 by manipulating the valves located on top of the upper end cap 29.

A retainer ring 197 is disposed circumferentially around the production riser 13 between the upper end cap 29 and the piston cap 191. The purpose of the retainer ring 197 is two-fold. First, the retainer ring 197 provides a positive up stop for the piston 87 and piston cap 191 as the tieback connector 11 is being unlocked. Second, as the tieback connector 11 is being unlocked, the retainer ring 197 provides a positive down stop for the housing 25. The retainer ring 197 engages a groove 199 in the upper end cap 29 when the housing 25 is in the unlocked position.

At least two mechanical release shafts 201 pass through the upper end cap 29 and are rigidly connected to the upper portion 89 of the piston 87. Release shaft 201 allows the tieback connector 11 to be unlocked manually should the external hydraulic pressure source 198 fail. Release shaft 201 is adapted to be engaged by a remote operated vehicle (not shown), which would supply an upward force to the release shaft 201 in order to move the piston 87 upward.

Referring to FIGS. 1–5, the operation of tieback connector 11 is illustrated. In operation, housing 25 is concentrically aligned with the wellhead housing 15, and the tieback connector 11 is stabbed onto the wellhead housing 15 such that riser shoulder 19 engages wellhead shoulder 21. When initially lowered over the wellhead housing 15, the tieback connector 11 is in the unlocked position. In the unlocked position, piston 87 is biased upward such that piston cap 191 engages retainer ring 197. The housing 25 is biased downward by gravity when tieback connector 11 is in the unlocked position such that the groove 199 in upper end cap 29 engages retainer ring 197. The downward bias of the housing 25 causes bands 73 of the housing 25 to align with the outer grooves 71 of the lower dogs 51. This alignment allows the lower dogs 51 to be able to shift radially outward as the tieback connector 11 is lowered onto the wellhead housing 15.

Tieback connector 11 is placed in the locked position by injecting hydraulic fluid through primary locking port 187 into intermediate chamber 183. As fluid enters intermediate chamber 183, a downward biasing force is exerted against upper side 95 of piston 87. However, piston 87 is initially unable to move due to interferences between upper dogs 119, housing 25, load transfer ring 135, and production riser 13 (see FIG. 4). The fluid also exerts an upward force on the lower portion 175 of inner seal sleeve 171. Since inner seal sleeve 171 abuts upper end cap 29, the upward force causes upper end cap 29 and housing 25 to move axially upward relative to both production riser 13 and wellhead housing 15.

As housing 25 moves upward, a force is exerted from the biasing surfaces 79 of the housing 25 onto biased surfaces 77 of the lower dogs 51 (see FIG. 2). The force applied to the biased surfaces 77 causes the lower dogs to move radially inward so that the teeth 55 on the lower dogs 51 engages the grooves 59 on the wellhead housing 15. After the lower dogs 51 have engaged grooves 59, housing 25 continues moving upward until landing shoulder 67 engages stop shoulders 65 of the lower dogs 51. The mating of stop shoulder 65 and landing shoulder 67 stops the upward movement of the housing 25. At this point, the lower dogs 51 have been fully biased radially inward, and the bands 73 of the housing 25 engage the outer surface of the lower dogs 51 to hold the teeth 55 of the lower dogs 51 in engagement with the grooves 59 of the wellhead housing 15.

With the lower dogs 51 engaging the wellhead housing 15, a rigid link is created between the production riser 13, the lower dog retainer ring 53, the lower dogs 51, and the wellhead housing 15. This link results in a secure connection between the production riser 13 and the wellhead housing 15.

With housing 25 biased upward, the teeth 127 of the upper dogs 119 align with the grooves 129 of the housing 25, thereby allowing the upper dogs 119 to move radially outward. Because there is no longer an interference between the upper dogs 119 and the interior surface of the housing 25, the force exerted by the hydraulic fluid on the upper side 95 of piston 87 causes the piston 87 to move downward. The lower portion 91 of the piston 87 exerts an outward force on the upper dogs 119, causing the upper dogs 119 to move radially outward. The lower landing surface 121 of the upper dogs 119 slides on the upper landing surface 137 of the load transfer ring 135 as the upper dogs 119 move outward. The upper dogs 119 cease their outward movement when their teeth 127 engage the grooves 129 of the housing 25.

Piston 87 and dog retraction ring 145 continue to move downward. Locking surface 115 of the piston 87 engages the interior locking surfaces 125 of upper dogs 119 as the piston moves downward. The relative inclines of locking surfaces 125 and locking surface 115 are such that upper dogs 119 are biased into an increasingly secure engagement with housing 25 as the piston 87 moves down. When the piston 87 is fully extended downward, the interference fit between locking surfaces 115 and 125 prevent the piston 87 from moving upward, even when hydraulic pressure in intermediate chamber 183 is relieved.

While the lower dogs 51 serve to connect production riser 13 to wellhead housing 15, the strength of the connection is dependent upon eliminating movement of housing 25. If the housing were to move downward, the lower dogs could become disengaged, thereby breaking the connection. Upper dogs 119 lock the housing 25 and prevent it from moving relative to production riser 13 and wellhead housing 15. The engagement between the upper dogs 119 and housing 25 produces a preload force through load transfer ring 135 between wellhead housing 15, riser 13, and tieback connector 11.

Tieback connector 11 can be unlocked in three different ways. The preferred method of unlocking the connector 11 involves injecting hydraulic fluid through primary release port 157 into lower chamber 109. The hydraulic fluid exerts an upward force on the lower side 97 of piston 87 that is sufficient to overcome the interference fit between locking surfaces 115 and 125. As the piston 87 moves upward, the lower portion 91 becomes disengaged from the upper dogs 119. The upward motion of the piston 87 is accompanied by upward movement of dog retraction ring 145. The retraction surface 149 of disengagement portion 147 comes in contact with the lower retraction surfaces 123 of the upper dogs 119. The inclined nature of these surfaces 123, 149 causes the dog retraction ring 145 to bias the upper dogs radially inward, thereby disengaging the teeth 127 of the dogs 119 from the grooves 129 of the housing 25. The piston 87 continues to move up until piston cap 191 is stopped by retainer ring 197.

After the housing 25 is "unlocked" from the upper dogs 119, the force exerted by the hydraulic fluid on shoulder 165 causes the housing 25 to move downward. The housing 25 continues to move down until the groove 199 in upper end cap 29 engages the retainer ring 197. The bands 73 associated with the housing 25 realign with the outer grooves 71 of the lower dogs 51 when housing 25 reaches its final downward position.

An upward force is applied to production riser 13 and tieback connector 11 to remove them from the wellhead housing. The inclined nature of teeth 55, 59 push the lower dogs 51 radially outward as the upward force is applied. The lower dogs 51 become disengaged from grooves 59, allowing the production riser 13 and the tieback connector 11 to be easily lifted from the wellhead housing 15.

A second way to release connector 11 is to inject hydraulic fluid through secondary release port 195 into upper chamber 193. The same steps of moving the piston 87 upward and moving the housing 25 downward are involved in this release operation, but the hydraulic fluid supplies force to different parts. Hydraulic fluid entering upper chamber 193 exerts an upward force on piston cap 191 which causes piston 87 to move upwards. After releasing the upper dogs 119, housing 25 moves downward because of the hydraulic pressure exerted on the inner seal sleeve 171.

Finally, a manual method of moving the piston 87 upward is provided. Release shaft 201 is adapted to be pulled upward by a remote operated vehicle. The vehicle would be used in the event of a hydraulic failure to disconnect the production riser 13 and the tieback connector 11 from the wellhead housing 15. By supplying a sufficient upward force to the release shaft 201, the piston 87 could be "pulled" upward in order to unlock the housing 25 from the upper dogs 119. The vehicle would then be used to supply a downward force to the upper end cap 29 and housing 25 in order to unlock the lower dogs 51.

Figure 6:
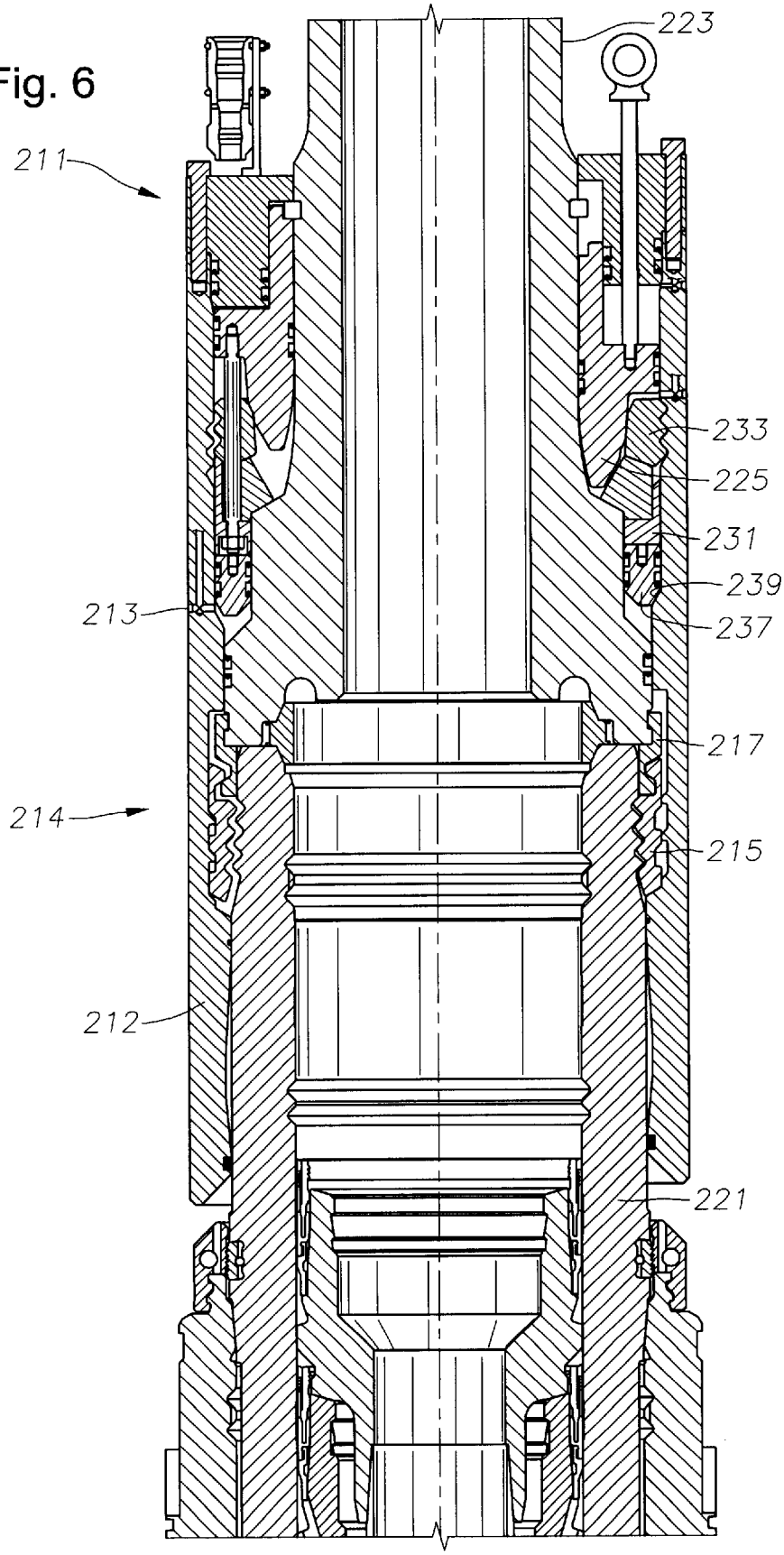
FIG. 6 is an alternate embodiment of the tieback connector of this invention, showing a locked position on the right and an unlocked position on the left.

Referring to FIG. 6 in the drawings, a tieback connector 211 according to an alternate embodiment of the present invention is illustrated. Tieback connector 211 is similar in structure and operation to tieback connector 11. Tieback connector 211 includes a housing 212. A lower locking system 214 having lower dogs 215 and a lower dog retainer ring 217 is identical to that of connector 11. The lower dogs 215 engage a wellhead housing 221 to form a connection between a production riser 223 and the wellhead housing 221.

Tieback connector 211 also includes a primary piston 225 that is analogous to piston 87 in connector 11. Primary piston 225 is cooperatively used with a dog retraction ring 231 to seat and dislodge a plurality of upper dogs 233 from engagement with housing 212. Similar to upper dogs 119 used with connector 11, upper dogs 233 are used to lock housing 212, thereby preventing the housing 212 from moving axially and preventing disengagement of the lower dogs 215 from the wellhead housing 221.

The primary difference between the tieback connectors 11 and 211 is that connector 211 includes a secondary release port 213 located differently from secondary release port 195 associated with connector 11. A secondary piston 237 is located in an annulus between housing 212 and production riser 223 just beneath dog retraction ring 231. When tieback connector 211 is in a locked position, with the upper dogs 233 engaging the housing 212, hydraulic fluid can be injected through secondary release port 213 to an area just beneath secondary piston 237. The hydraulic fluid exerts an upward force on the secondary piston 237 which begins to move upward, pushing both the dog retraction ring 231 and the primary piston 225 upward. As the primary piston 225 moves upward, the dog retraction ring 231 forces the upper dogs 233 radially inward and away from housing 212, thereby allowing the hydraulic fluid to exert a downward force on a shoulder 239 to move housing 212 in a downward direction relative to production riser 223 and wellhead housing 221. As housing 212 moves downward, the lower dogs 215 disengage the wellhead housing 221 such that the production riser 223 and tieback connector 211 can be removed from the wellhead housing 221.

Figure 7:
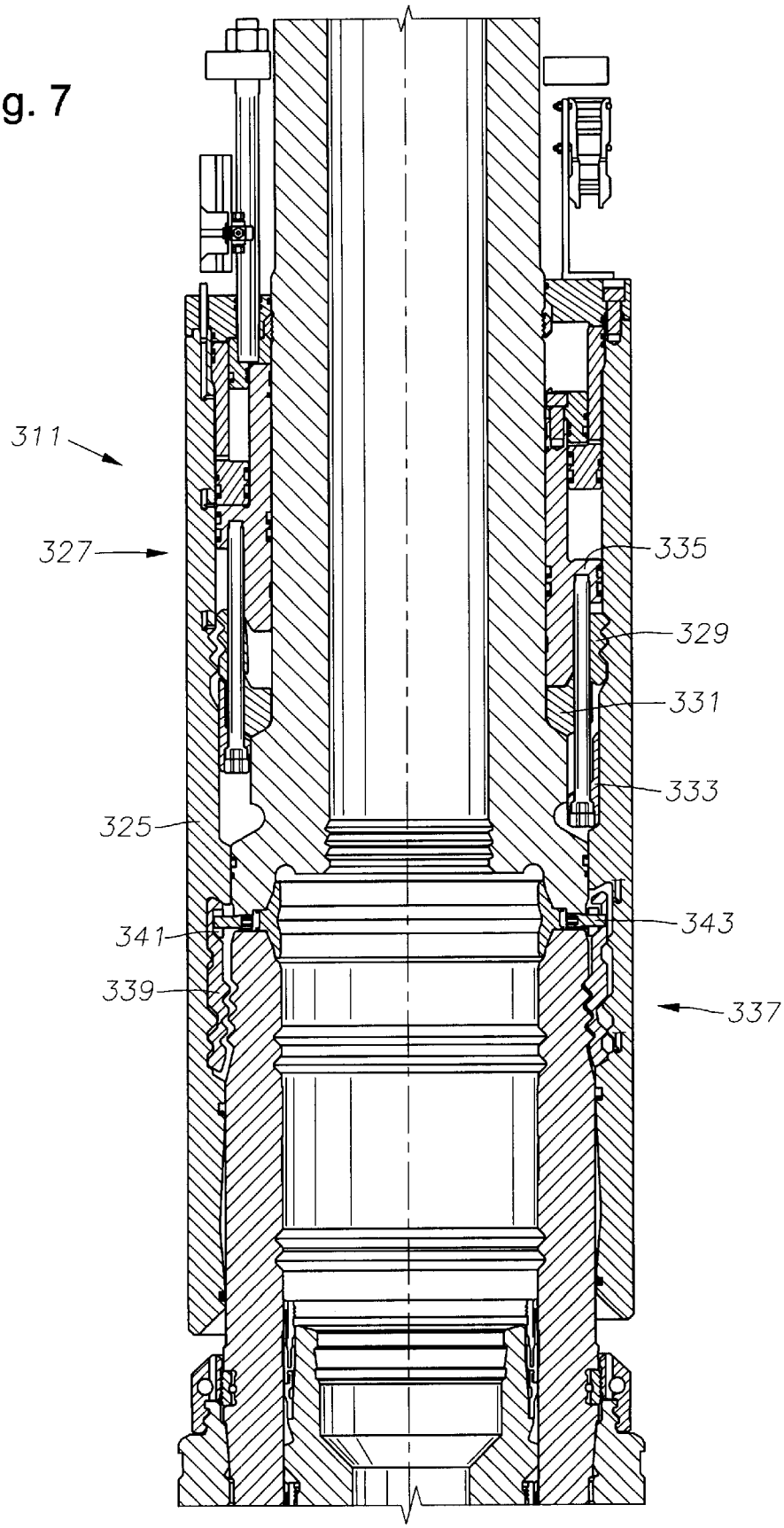
FIG. 7 is another alternate embodiment of the tieback connector of this invention, showing a locked position on the right and an unlocked position on the left.

Referring to FIG. 7 in the drawings, a tieback connector 311 according to another alternate embodiment of the present invention is illustrated. Tieback connector 311 is similar in structure and operation to tieback connector 11 (FIGS. 1–5). Tieback connector 311 includes a housing 325 similar to housing 25. An upper locking system 327, having upper dogs 329, load transfer ring 331, dog retraction ring 333 and a piston 335, that is identical to upper locking system 45 of connector 11.

Tieback connector 311 also includes a lower locking system 337 analogous to lower locking system 47. Lower locking system 337 has lower dogs 339 analogous to lower dogs 51 that engage wellhead housing 15.

The primary difference between the tieback connectors 11 and 311 is that connector 311 includes a c-ring 341 and a plurality of retaining pins 343, instead of retaining ring 53, to hold lower dogs 339 in position. Retaining pins 343 slidingly engages an upper end of dogs 339 such that dogs 339 may move vertically relative to pins 343. C-ring 341 is secured vertically by pins 343 and is positioned inside an upper portion of dogs 339. C-ring 341 exerts an outward force on the upper portion of dogs 339 keeping them adjacent outer housing 325 until engaged. As outer housing 325 lowers it engages lower dogs 339 in the same manner as connector 11, except that c-ring 341 is compressed by the engagement. This configuration prevents lower dogs 339 from interfering when connector 311 is lowered into position or removed from wellhead housing 15.

A primary advantage of the present invention is the use of the housing to effect engagement between the lower dogs and the wellhead housing. Typically, dogs used in other connectors use a piston to directly engage the dogs. The current invention places the piston in an area surrounding the production riser. The piston is used to lock the housing, the housing being the activator of the lower dogs. The result of the above features is that the overall diameter of the connector can be substantially reduced when compared to connectors using a piston in the area near the lower dogs.

Another advantage of the current invention includes the use of two separate locking systems, each locking system being activated independently. As explained above, the lower dogs, a passive locking mechanism, serve to connect the production riser to the wellhead housing and are activated by the housing of the tieback connector without having to generate high locking forces. The upper dogs, an active locking mechanism, are used to lock the housing relative to the production riser and the wellhead housing. The upper dogs are activated by the piston.

Still another advantage of the present invention involves the multiple methods by which the tieback connector can be unlocked from the wellhead housing. Two of the methods involve using hydraulic fluid to move the piston and housing, hydraulic fluid being injected through the primary release port in one method and being injected through the secondary release port in the other. A third, manual method allows a remote operated vehicle to supply the necessary force to unlock the tieback connector.

It should be apparent from the foregoing that an invention having significant advantages has been provided. While the invention is shown in only a few of its forms, it is not just limited but is susceptible to various changes and modifications without departing from the spirit thereof. Furthermore, while the invention is shown attaching a production riser to a wellhead housing, it may be used to connect a drilling riser to a wellhead housing, or almost any tubular member to any wellhead member where a secure connection and a small diameter connector are advantageous.

We claim:

1. A connector for connecting a subsea well member to a riser, the well member having a tubular upper portion having an external surface with a grooved profile, the connector comprising:

a lower terminal adapted to be connected to the riser and land on the upper portion of the well member;

a housing carried by the lower terminal for sliding over the upper portion of the well member, the housing being axially movable relative to the lower terminal;

a lower locking element carried by the housing for engaging the grooved profile while in a locked position and being radially spaced from the grooved profile while in an unlocked position;

a lower cam surface carried by the housing for axial movement therewith relative to the lower locking element to move the locking element from the unlocked to the locked position; and an actuator carried around the lower terminal for causing the axial movement of the housing and the cam surface.

2. A connector for connecting a subsea well member to a riser, the well member having a tubular upper portion having an external surface with a grooved profile, the connector comprising:

a lower terminal adapted to be connected to the riser and land on the upper portion of the well member;

a housing carried by the lower terminal for sliding over the upper portion of the well member;

a lower locking element carried by the housing for engaging the grooved profile while in a locked position and being radially spaced from the grooved profile while in an unlocked position;

a lower cam surface carried by the housing for axial movement relative to the lower locking element to move the locking element from the unlocked to the locked position;

an actuator carried around the lower terminal for causing the axial movement of the cam surface; wherein:

said cam surface is formed on an inner surface of said housing; and said actuator moves said housing.

3. The connector of claim 1 further comprising:

an internal groove located within the housing for movement therewith; and an upper locking member that is moved by said actuator into engagement with said internal groove to lock said housing against axial movement relative to said terminal.

4. The connector of claim 1 wherein:

said actuator is comprised of an annular piston disposed between said housing and said lower terminal.

5. The connector of claim 1 wherein:

said actuator is comprised of a piston within said housing; and an upper locking member locks said actuator in a locked position.

6. A connector for connecting a subsea well member to a riser, the well member having a tubular upper portion having an external surface with a grooved profile, the connector comprising:

a lower terminal adapted to be connected to the riser and land on the upper portion of the well member;

a housing carried by the lower terminal for sliding over the upper portion of the well member;

a lower locking element carried by the housing for engaging the grooved profile while in a locked position and being radially spaced from the grooved profile while in an unlocked position;

a lower cam surface carried by the housing for axial movement relative to the lower locking element to move the locking element from the unlocked to the locked position;

an actuator carried around the lower terminal for causing the axial movement of the cam surface; wherein:

said actuator is comprised of an annular piston disposed between said housing and said lower terminal;

an upper locking member locks said actuator in a locked position; and a load transfer ring is disposed between said locking member and said lower terminal.

7. A connector for connecting a subsea well member to a riser, the well member having a tubular upper portion having an external surface with a grooved profile, the connector comprising:

a lower terminal adapted to be connected to the riser and land on the upper portion of the well member;

a housing carried by the lower terminal for sliding over the upper portion of the well member;

a lower locking element carried by the housing for engaging the grooved profile while in a locked position and being radially spaced from the grooved profile while in an unlocked position;

a lower cam surface carried by the housing for axial movement relative to the lower locking element to move the locking element from the unlocked to the locked position;

an actuator carried around the lower terminal for causing the axial movement of the cam surface; wherein:

said cam surface is formed on an inner wall of said housing;

said actuator is a piston within said housing which moves said housing axially;

an upper locking member locks said actuator in a locked position; and a load transfer ring is positioned between said upper locking member and said lower terminal.

8. The connector of claim 1 further comprising:

a mechanical release shaft attached to said actuator extending upwards out of the top of said connector.

9. A connector for connecting a subsea well member to a riser, the well member having a tubular upper portion having an external surface with a grooved profile, the connector comprising:

a lower terminal adapted to be connected to the riser and land on the upper portion of the well member;

a housing carried by the lower terminal for sliding over the upper portion of the well member;

a lower locking element carried by the housing for engaging the grooved profile while in a locked position and being radially spaced from the grooved profile while in an unlocked position;

a lower cam surface formed on an inner wall of said housing for axial movement relative to the lower locking element to move the locking element from the unlocked to the locked position;

a piston carried within said housing around the lower terminal for causing the axial movement of the housing;

an upper locking member for engaging a profile on an inner surface of said housing to lock said piston when in a locked position and being radially spaced from said profile when in an unlocked position;

an upper cam surface which is moved axially by said piston to cam said upper locking member radially into a locked position; and a load transfer ring positioned between said upper locking member and said lower terminal.

10. The connector of claim 9 further comprising:

a mechanical release shaft attached to said piston extending upwards out of the top of said connector.

11. The connector of claim 9 further comprising:

a bolt extending from said piston to a retraction ring positioned below said upper locking member to release said upper locking member from said housing.

12. A connector for connecting a riser to a well member comprising:

a lower terminal adapted to attach to said riser and abut an upper end of said well member;

an outer housing which is removably secured to said well member by a lower locking system and seals said riser to said well member with an upper locking system;

said lower locking system comprising:

a lower locking element with inner teeth which lock into outer grooves on said well member and an outer profile with cam surfaces that interact with cam surfaces on an interior surface of said outer housing such that when said outer housing is raised relative to said lower locking element, said lower locking element is moved into locking engagement with said well member;

a lower retaining ring which is connected to a lower end of said lower terminal and engages an upper end of said lower locking element to ensure proper alignment of said lower locking element with said well member and to retain said lower locking member in said outer housing;

said upper locking system comprising:

a piston positioned between an inner surface of said outer housing and an outer surface of said lower terminal, said piston having a lower thick portion and an upper thin portion that is adjacent to said outer surface of said lower terminal;

a lower chamber located between said outer housing and said piston below said piston;

an upper locking element positioned below said piston adjacent said inner surface of said outer housing and having grooves on an outer surface which mate with a profile on said inner surface of said outer housing when aligned;

a load transfer ring below said upper locking element and adjacent said lower terminal to transfer loads form said upper locking element downward onto said lower terminal;

a retraction ring generally below said load transfer ring and attached to said piston with a retainer bolt, said retraction ring having an upper disengagement portion that when raised acts to pry said upper locking element from engagement with said outer housing;

an inner seal sleeve between said outer housing and said upper portion of said piston, said inner seal sleeve being movable in unison with said outer housing and having an L-shaped cross-section which forms an intermediate chamber between a lower surface of said second inner seal sleeve and an upper surface of said lower thick portion of said piston; and a piston cap extending from said upper thin portion of said piston to an inner surface of said inner seal sleeve, said piston cap being movable in unison with said piston and forming an upper chamber between said piston and said inner seal sleeve.

13. The connector of claim 12 further comprising:

a primary locking port which communicates with said intermediate chamber;

a primary release port which communicates with said lower chamber; and a secondary release port which communicates with said upper chamber.

14. The connector of claim 12 further comprising:

a mechanical release shaft attached to said first piston extending upwards out of the top of said connector.

15. A method for connecting a riser to a well member comprising the following steps:

providing a connector with a lower terminal, a housing, an actuator between said housing and said lower terminal, and a lower locking element below said lower terminal;

attaching said lower terminal on a lower end of said riser;

lowering said connector and said lower terminal onto said well member such that said housing and lower locking element is around said well member and a lower end of said lower terminal abuts said well member; and activating said actuator such that said housing moves axially downward relative to said lower locking element and cams said lower locking element radially inward into engagement with a grooved profile on an exterior of said well member.

16. The method of claim 15 further comprising the step of:

further activating said actuator to move an upper locking element into a locked position that prevents further movement of said actuator.

17. A connector for connecting a well member to a riser, the well member having a tubular upper portion with an external surface having an external grooved profile, the connector comprising:

a lower terminal adapted to be connected to the riser and having a lower end that is adapted to land on the upper portion of the well member;

a housing carried by the lower terminal for sliding over the upper portion of the well member, the housing having an internal grooved profile above the lower end of the lower terminal;

a lower locking element carried by the housing below the lower end of the terminal for engaging the external grooved profile while in a locked position;

an upper locking member carried in the housing above the lower end of the terminal for movement radially outward from a retracted position to a locked position engaging the internal grooved profile after the lower locking member is in the locked position; and a piston carried in the housing above the lower end of the terminal for moving the upper locking member to the locked position, the upper locking member being positioned so that as it engages the internal grooved profile, an upward preload force is applied to the housing to preload the engagement of the lower locking element with the external grooved profile.

18. A method for connecting a well member to a riser, the well member having a tubular upper portion with an external surface having an external grooved profile, the method comprising:

providing a connector with a housing having an internal grooved profile, and upper and lower locking elements carried by the housing;

attaching the connector to a riser and lowering the housing over the upper portion of the well member;

engaging the lower locking element with the external grooved profile; then engaging the upper locking element with the internal grooved profile, the entry of the upper locking element into the internal profile causing an upward preload force to be applied to the housing that is reacted by the engagement of the lower locking element with the external grooved profile.

* * * * *

UNITED STATES PATENT AND TRADEMARK OFFICE

CERTIFICATE OF CORRECTION

PATENT NO. : 6,540,024 B2
DATED : April 1, 2003
INVENTOR(S) : Joe Pallini et al.

It is certified that error appears in the above-identified patent and that said Letters Patent is hereby corrected as shown below:

Column 1,
Line 44, insert -- a -- before "grooved"

Column 7,
Line 59, delete "that" before "is identical"

Column 8,
Line 44, delete "just" and insert therefor -- so --

Signed and Sealed this

Thirtieth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,540,024 B2
DATED : April 1, 2003
INVENTOR(S) : Joe Pallini et al.

It is certified that error appears in the above-identified patent and that said Letters Patent is hereby corrected as shown below:

Column 12,
Line 12, delete “downward” and insert -- upward -- in its place.

Signed and Sealed this

Tenth Day of February, 2004

JON W. DUDAS
*Acting Director of the United States Patent and Trademark Office*